US008145108B2

(12) United States Patent
Murakami et al.

(10) Patent No.: US 8,145,108 B2
(45) Date of Patent: Mar. 27, 2012

(54) IMAGE FORMING APPARATUS

(75) Inventors: Junichi Murakami, Ebina (JP); Atsuyuki Kitamura, Ebina (JP); Masahiro Sato, Ebina (JP); Atsushi Ogihara, Ebina (JP); Tetsuji Okamoto, Ebina (JP); Koichi Watanabe, Ebina (JP); Shuichi Nishide, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 67 days.

(21) Appl. No.: 12/880,611

(22) Filed: Sep. 13, 2010

(65) Prior Publication Data

US 2011/0194878 A1 Aug. 11, 2011

(30) Foreign Application Priority Data

Feb. 10, 2010 (JP) ..... 2010-027991

(51) Int. Cl.
*G03G 15/01* (2006.01)

(52) U.S. Cl. ..... 399/304

(58) Field of Classification Search ..... 399/304, 399/297–303, 305–319, 121, 101, 66; 271/3.14, 271/228, 247, 249, 252, 268, 85, 82, 204, 271/206, 277

See application file for complete search history.

(56) References Cited

U.S. PATENT DOCUMENTS 5,335,056 A * 8/1994 Muramatsu ..... 399/82
6,163,676 A * 12/2000 Levanon et al. ..... 399/316

FOREIGN PATENT DOCUMENTS

JP A-6-230687 8/1994

* cited by examiner

*Primary Examiner* — Kiho Kim
(74) *Attorney, Agent, or Firm* — Oliff & Berridge, PLC

(57) ABSTRACT

An image forming apparatus includes: an image carrier; a transfer member transfers the image carried on the outer circumferential surface of the image carrier onto a recording medium; a holding member that holds, on an outer circumferential surface of the transfer member, the recording medium fed to the transfer member; and a control unit that performs control so that in first image formation operation in which images of plural colors carried by the image carrier are sequentially transferred onto a single recording medium one color at a time, the holding member holds the recording medium on the transfer member, and in second image formation operation in which an image of a single color carried by the image carrier is transferred onto a single recording medium, the holding member does not hold, the recording medium on the transfer member.

6 Claims, 6 Drawing Sheets

MULTI-COLOR IMAGE-QUALITY PRIORITY MODE

MULTI-COLOR PRODUCTIVITY PRIORITY MODE

MULTI-COLOR
IMAGE-QUALITY PRIORITY MODE

MULTI-COLOR
PRODUCTIVITY PRIORITY MODE

MONOCHROME
IMAGE-QUALITY PRIORITY MODE

FIRST MONOCHROME
PRODUCTIVITY PRIORITY MODE
AND
SECOND MONOCHROME
PRODUCTIVITY PRIORITY MODE

IMAGE FORMING APPARATUS

CROSS REFERENCE TO RELATED APPLICATIONS

This application is based on and claims priority under 35 USC §119 from Japanese Patent Application No. 2010-027991 filed Feb. 10, 2010.

BACKGROUND

1. Technical Field

The present invention relates to an image forming apparatus.

2. Related Art

There is known an image forming apparatus including a photoconductor which rotates while carrying a toner image and a transfer drum which faces the photoconductor and rotates while carrying a transfer material. The toner image carried by the photoconductor is transferred onto the transfer material carried by the transfer drum.

SUMMARY

According to an aspect of the present invention, there is provided an image forming apparatus including: an image carrier that is rotatably installed and carries an image on an outer circumferential surface of the image carrier; a transfer member that is rotatably installed facing the image carrier, and transfers the image carried on the outer circumferential surface of the image carrier onto a recording medium nipped between the transfer member and the image carrier; a holding member that holds, on an outer circumferential surface of the transfer member, the recording medium fed to the transfer member; and a control unit that performs control so that in first image formation operation in which images of plural colors carried by the image carrier are sequentially transferred onto a single recording medium one color at a time, the holding member holds the recording medium on the transfer member, and in second image formation operation in which an image of a single color carried by the image carrier is transferred onto a single recording medium, the holding member does not hold the recording medium on the transfer member.

BRIEF DESCRIPTION OF THE DRAWINGS

Exemplary embodiments of the present invention will be described in detail based on the following figures, wherein.

DETAILED DESCRIPTION

An exemplary embodiment of the present invention is described in detail with reference to the accompanying drawings.

Figure 1:
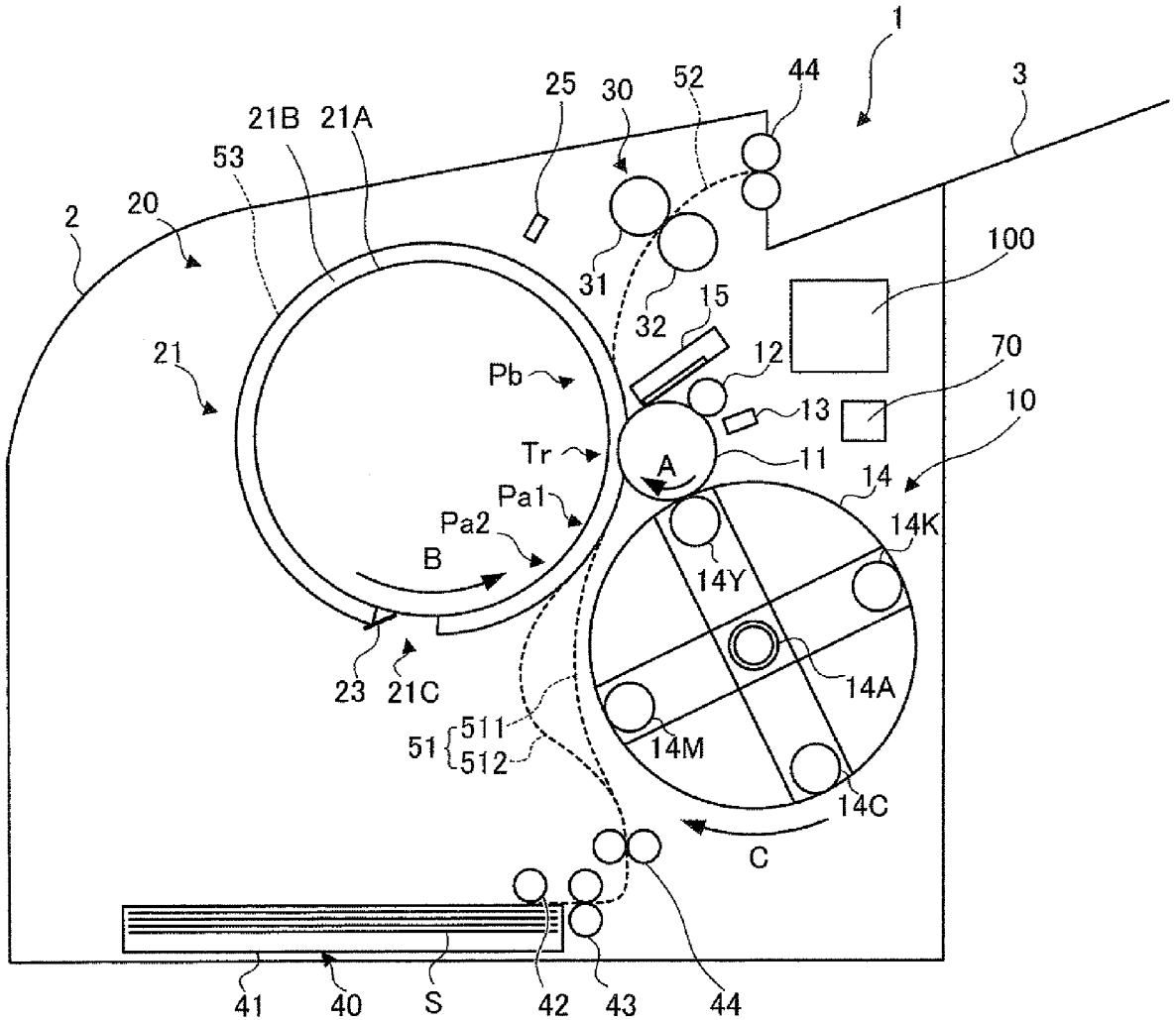
FIG. 1 is a schematic configuration diagram showing an image forming apparatus to which an exemplary embodiment of the present invention is applied.

FIG. 1 is a schematic configuration diagram of an image forming apparatus 1 to which the present exemplary embodiment is applied.

The image forming apparatus 1 includes: an image forming unit 10 that is an example of an image forming unit and forms a toner image; a transfer device 20 that carries a sheet S fed thereto and transfers the toner image formed by the image forming unit 10, onto the sheet S thus carrying; a fixing device 30 that fixes the toner image on the sheet S released by the transfer device 20; a sheet feeding unit 40 that feeds and transports the sheet S; and a controller 100 that is an example of a control unit and a setting part, and performs overall control of the image forming apparatus 1. The constituents of the image forming apparatus 1 are housed in a housing 2. The housing 2 is provided, at its top portion, with an outputted-sheet stacking unit 3 on which the sheet S outputted from the fixing device 30 is stacked. Here, the sheet S is an example of a recording medium.

The image forming unit 10 includes: a photoconductive drum 11 which is an example of an image carrier; a charging device 12 that charges the photoconductive drum 11; a light-exposing device 13 that exposes the charged photoconductive drum 11 to light; a rotary developing device 14 that performs development using toner; and a cleaning device 15 that cleans remaining toner and the like off the photoconductive drum 11.

The photoconductive drum 11 includes, on its surface, a photoconductive layer (not shown) having a negative charge polarity, and is installed to rotate in a direction of an arrow A. The charging device 12, the light-exposing device 13, the rotary developing device 14, and the cleaning device 15 are installed around the photoconductive drum 11 in this order in the direction of the arrow A. Here, the photoconductive drum 11 has an outer diameter of, for example, 30 mm.

The charging device 12 is a discharge device of a contact roller type in the present exemplary embodiment, and is configured to charge the photoconductive drum 11 while rotating with the photoconductive drum 11.

The light-exposing device 13 is configured to form an electrostatic latent image on the photoconductive drum 11 by irradiating the charged surface of the photoconductive drum 11 with light, and includes multiple LEDs (not shown) in the present exemplary embodiment.

The rotary developing device 14 includes a rotary shaft 14A and developing parts 14Y for yellow (Y), 14M for magenta (M), 14C for cyan (C), and 14K for black (K) arranged around the rotary shaft 14A. The rotary developing device 14 is configured to rotate about the rotary shaft 14A in a direction of an arrow C, and configured so that any of the developing parts may stop at a position facing the photoconductive drum 11 (this position is called a development position in the following description). The rotary developing device 14 is configured to develop, using toner, the electrostatic latent image formed on the photoconductive drum 11 by the light-exposing device 13. Note that the rotary developing device 14 has an outer diameter of, for example, 100 mm.

Each of the developing parts 14Y, 14M, 14C, and 14K houses therein a two-component developer containing toner of a corresponding color component and a carrier. Although the present exemplary embodiment uses a two-component developer, a one-component developer containing no carrier may be used instead.

The cleaning device 15 is configured to remove toner and other extraneous matter remaining on the surface of the photoconductive drum 11. The cleaning device 15 of the present exemplary embodiment is a blade-type cleaner.

Next, the transfer device 20 is described. The transfer device 20 is installed rotatably facing the photoconductive drum 11, and includes: a transfer drum 21 that transfers the toner image formed on the photoconductive drum 11 onto the sheet S; a gripper 23 that grips the sheet S on the transfer drum 21; and a phase sensor 25 that detects the phase of the rotating transfer drum 21. Here, the transfer drum 21 is configured to rotate, at a position facing the photoconductive drum 11, in a direction of an arrow B which is the same direction as a rotation direction of the photoconductive drum 11 (the direction of the arrow A).

The transfer drum 21 is an example of a transfer member, and includes: a cylindrically-shaped cylindrical base 21A that has a space therein; and an elastic layer 21B formed on an outer circumferential surface of the cylindrical base 21A. Here, the elastic layer 21B does not cover a part of the outer circumferential surface of the cylindrical base 21A, the part extending in an axial direction of the cylindrical base 21A. This part is an exposed portion 21C where the cylindrical base 21A is exposed to the outside.

In FIG. 1, the transfer drum 21 includes the exposed portion 21C where the cylindrical base 21A is exposed to the outside. Note, however, that the present invention is not limited to such configuration. Specifically, a part of the outer circumferential surface of the cylindrical base 21A does not necessarily have to be exposed, but instead, a part of the elastic layer 21B may be formed thin, for example.

The position of the transfer drum 21 relative to the photoconductive drum 11 is set so that, along with its rotation, the elastic layer 21B may come in contact with the photoconductive drum 11 and the gripper 23 on the cylindrical base 21A may not come in contact with the photoconductive drum 11. The elastic layer 21B of the transfer drum 21 is elastically deformed by coming in contact with the photoconductive drum 11, and thus forms a nip portion between the transfer drum 21 and the photoconductive drum 11. In this nip portion, the toner image formed on the photoconductive drum 11 is transferred onto the sheet S. Further, a transfer power supply (not shown) is connected to the transfer drum 21 so as to supply a transfer bias with which the toner image formed on the photoconductive drum 11 is transferred onto the sheet S at an area where the photoconductive drum 11 and the transfer drum 21 face each other. Note that, in the following description, the area where the photoconductive drum 11 and the transfer drum 21 face each other is called a transfer portion Tr.

The cylindrical base 21A of the present exemplary embodiment is a conductive hollow tube which, specifically, is made of a resin. In the present exemplary embodiment, the cylindrical base 21A is formed by covering, with a conductive sheet, a raw tube which is made of a resin and has an outer diameter of 110 mm.

The elastic layer 21B is a semiconductive elastic member which, specifically, is made of a foamed rubber with a 5.0 mm thickness. In the present exemplary embodiment, the total outer diameter of the cylindrical base 21A having the elastic layer 21B therearound is 120 mm.

The gripper 23 constituting the transfer device 20 is an example of a holding member, and is attached to the exposed portion 21C of the transfer drum 21. The gripper 23 is configured to grip a transport direction leading edge portion of the sheet S and to release the grip between the gripper 23 and the elastic layer 21B, at an area close to an edge portion of the elastic layer 21B located downstream of the exposed portion 21C in the rotation direction of the transfer drum 21. The gripper 23 of the present exemplary embodiment is formed of a plate-shaped member, and an edge portion thereof (located downstream in the direction of the arrow B which is the rotation direction of the transfer drum 21) is rotatably secured to the exposed portion 21C, and the other edge thereof (located upstream in the direction of the arrow B which is the rotation direction of the transfer drum 21) is a free edge. With this configuration, the gripper 23 is swingable and is able to open and close to grip the sheet S.

In FIG. 1, the free edge of the gripper 23 protrudes from an outer circumferential surface of the elastic layer 21B. Note, however, that the present invention is not limited to such configuration. For example, the gripper 23 may be configured not to protrude from the outer circumferential surface. For example, the gripper 23 may be housed inside the exposed portion 21C. This configuration allows the gripper 23 not to come in contact with the photoconductive drum 11.

In the transfer drum 21 of the present exemplary embodiment, the sheet S is gripped not by using so-called electrostatic absorption. Instead, the sheet S is gripped mechanically by using the gripper 23. Accordingly, the transfer drum 21 is not provided with a charging device, such as a corotron, for electrostatically attracting the sheet S.

The phase sensor 25 is installed facing an outer circumferential surface of the transfer drum 21, and is configured to measure the phase of the rotating transfer drum 21 by detecting a mark (not shown) formed on the outer circumferential surface of the transfer drum 21. The controller 100 controls a start position for the image formation (color registration) according to a phase signal sent from the phase sensor 25.

Note that, in the present exemplary embodiment, a rotation sensor 70 is provided to detect the rotation (phase) of the photoconductive drum 11.

In the example illustrated above, the gripper 23 grips, on the transfer drum 21, only the transport direction leading end portion of the sheet S. Moreover, a configuration for gripping an end portion of the sheet S opposite to the leading end portion in the transport direction may be provided additionally.

Here, the maximum length of the sheet S usable in the image forming apparatus 1 of the present exemplary embodiment is set equal to or smaller than the circumferential length (the length in the direction of the arrow B) of the elastic layer 21B of the transfer drum 21. The sheet S is fed to the transfer drum 21 in such a manner as not to cross over the exposed portion 21C.

The fixing device 30 includes: a heating roll 31 that has a heating source (not shown) and is installed rotatably; and a pressing roll 32 that is pressed against the heating roll 31.

The sheet feeding unit 40 includes: a sheet housing part 41 that is provided at a lower part of the image forming apparatus 1, specifically, below the transfer drum 21, and houses the sheet S inside; a pickup roll 42 that picks up the sheet S from the sheet housing part 41; separation rolls 43 that separate closely-stacked sheets S apart; and transport rolls 44 that transport the sheet S.

The image forming apparatus 1 has a feeding route 51 through which the sheet S is fed from the sheet housing part 41 to the transfer portion Tr. In the present exemplary embodiment, the feeding route 51 includes more than one route: a first feeding route 511 and a second feeding route 512. In the present exemplary embodiment, the sheet S is fed to the transfer drum 21 through any one of the first feeding route 511 and the second feeding route 512. Note that the first feeding route 511 and the second feeding route 512 are switched using a gate (not shown). In the present exemplary embodiment, the sheet S is fed through the first feeding route 511 to a first sheet feeding position Pa1 located upstream of the transfer portion Tr in the rotation direction of the transfer drum 21, or through the second feeding route 512 to a second sheet feeding position Pa2 located upstream of the transfer portion Tr and further upstream of the first sheet feeding position Pa1 in the rotation direction of the transfer drum 21.

In addition, the image forming apparatus 1 has an output route 52 through which the sheet S onto which the toner image has been transferred at the transfer portion Tr is outputted to the outputted-sheet stacking unit 3 through the fixing device 30. In the present exemplary embodiment, the sheet S is outputted to the fixing device 30 from a sheet output position Pb located downstream of the transfer portion Tr in the rotation direction of the transfer drum 21.

Further, in the present exemplary embodiment, in some cases, the sheet S fed to the transfer drum 21 rotates while being placed around the transfer drum 21 by the gripper 23. The route that the sheet S takes at this time is called a rotation route 53.

Figure 2:
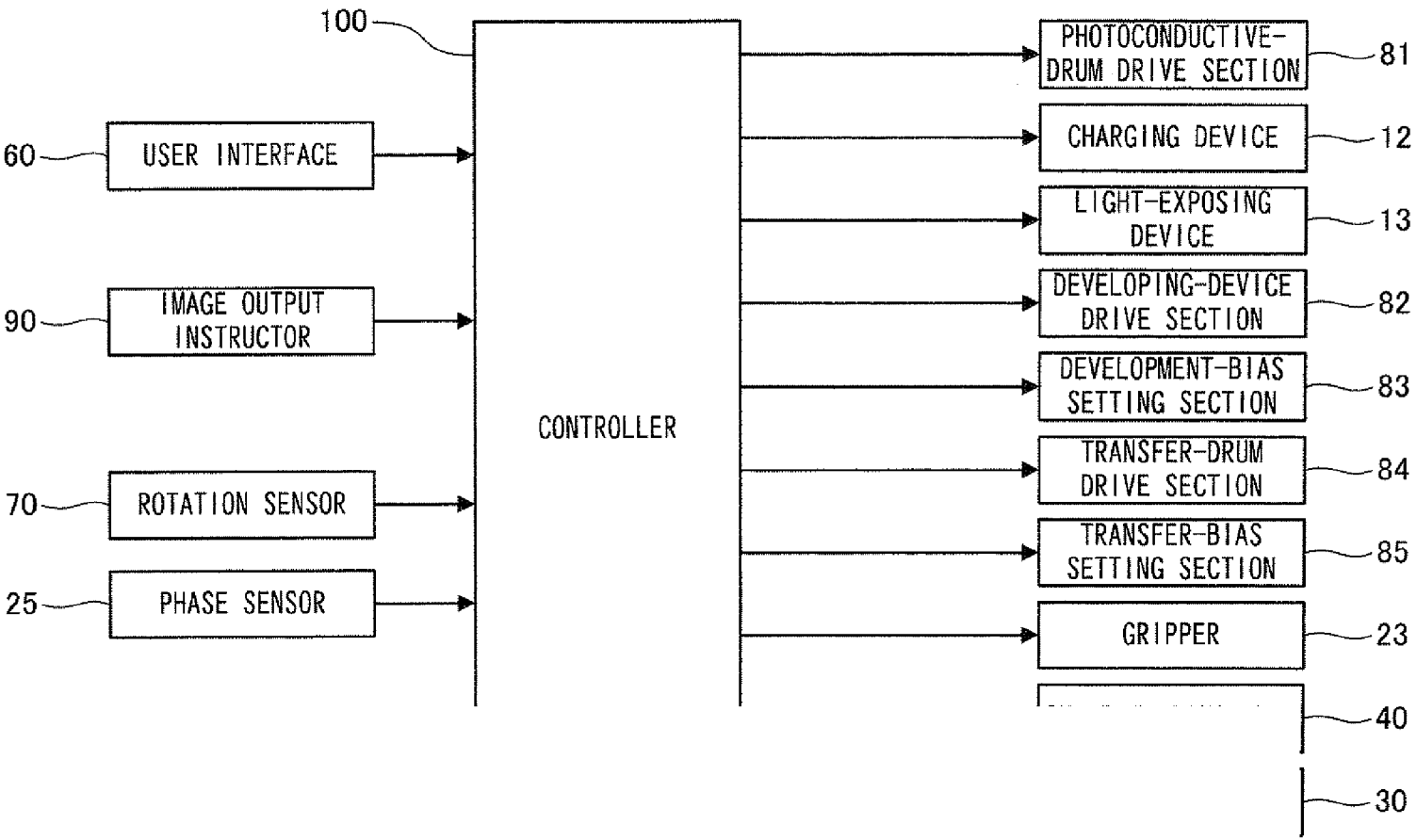
FIG. 2 is a functional block diagram of a controller.

FIG. 2 shows a functional block diagram of the controller 100 shown in FIG. 1.

The controller 100 of the present exemplary embodiment receives a signal from a user interface 60 through which a user makes a command. In addition, the controller 100 receives an image signal from an image output instructor 90 provided inside or outside the image forming apparatus 1. The controller 100 also receives a signal indicating the phase of the photoconductive drum 11 (called a first phase signal below) sent from the rotation sensor 70 and a signal indicating the phase of the transfer drum 21 (called a second phase signal below) sent from the phase sensor 25.

The controller 100 is configured to output a control signal to each of: a photoconductive-drum drive section 81 that drives and rotates the photoconductive drum 11; the charging device 12; the light-exposing device 13; a developing-device drive section 82 that positions a target one of the developing parts to the development position facing the photoconductive drum 11 by rotating and stopping the rotary developing device 14; a development-bias setting section 83 that sets a development bias to be supplied to the developing part placed at the development position; a transfer-drum drive section 84 that drives and rotates the transfer drum 21; a transfer-bias setting section 85 that sets a transfer bias to be supplied to the transfer drum 21; the gripper 23; the sheet feeding unit 40; and the fixing device 30. Moreover, to the light-exposing device 13, the controller 100 outputs not only a signal for light exposure, but also a signal for setting a light-exposure cycle in a second scan direction. Note that the light-exposure cycle in the present exemplary embodiment is time from a start of light exposure for one line in a first scan direction to a start of light exposure for the next line in the first scan direction which is adjacent to the one line in the second scan direction.

The controller 100 further outputs a signal indicating whether or not to supply a transfer bias to the transfer-bias setting section 85. Further, to the gripper 23, the controller 100 outputs a signal for opening or closing the gripper 23 according to the second phase signal sent from the phase sensor 25. Furthermore, to the sheet feeding unit 40, the controller 100 outputs a signal indicating which of the first feeding route 511 and the second feeding route 512 to use to feed the sheet S.

Next, a description is given of modes of image forming operation executed by the image forming apparatus 1 according to the present exemplary embodiment. The image forming apparatus 1 of the present exemplary embodiment is capable of performing multi-color image formation and monochrome image formation on the sheet S.

Here, the multi-color image formation in the present exemplary embodiment refers to image formation using two or more colors of yellow (Y), magenta (M), cyan (C), and black (K). Note that colors of the multi-color image formation are not limited to these colors.

The monochrome image formation in the present exemplary embodiment, on the other hand, refers to image formation using any one of yellow (Y), magenta (M), cyan (C), and black (K). Note that a color of the monochrome image formation is not limited to these colors.

Figure 3:
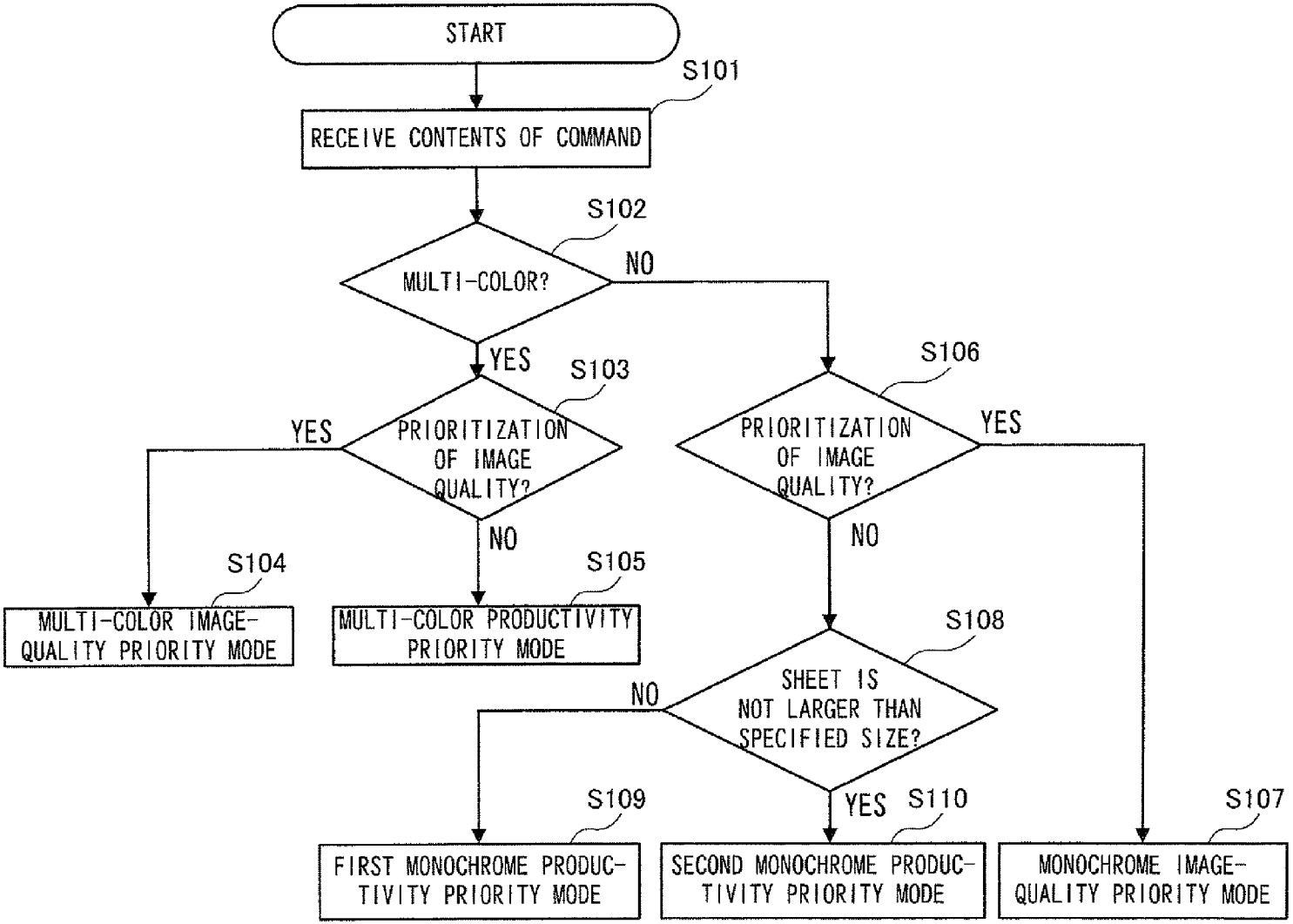
FIG. 3 is a flowchart illustrating mode selection for image formation operation.

Next, using FIG. 3, a description is given of mode selection for the image formation operation executed by the image forming apparatus 1. FIG. 3 is a flowchart in which the controller 100 selects the mode of the image formation operation in the image forming apparatus 1.

First, through the user interface 60, the controller 100 receives contents of a command for image formation operation made by the user (Step 101). Then, the controller 100 checks the contents of the command received at Step 101, and determines whether an image to be formed involves multi-color or not, or in other words, a monochrome or not (Step 102). When affirmative determination (Y) is made at Step 102, the controller 100 refers to the contents of the command received at Step 101, and determines whether the command designates prioritization of image quality or not (Step 103). When affirmative determination (Y) is made at Step 103, the controller 100 executes image formation operation in a multi-color image-quality priority mode in which image quality is prioritized over productivity (Step 104). When negative determination (N) is made at Step 103, on the other hand, the controller 100 executes image formation operation in a multi-color productivity priority mode in which productivity is prioritized over image quality (Step 105).

Meanwhile, when negative determination (N) is made at Step 102, or in other words, an image to be formed involves not multiple colors but a single color, the controller 100 refers to the contents of the command received at Step 101, and determines whether the command designates prioritization of image quality or not (Step 106). When affirmative determination (Y) is made at Step 106, the controller 100 executes image formation operation in a monochrome image-quality priority mode in which image quality is prioritized over productivity (Step 107). When negative determination (N) is made at Step 106, on the other hand, the controller 100 refers to the contents of the command received at Step 101, and determines whether the transport direction length of the sheet S on which an image is to be formed is not larger than a predetermined, specified size (Step 108). When negative determination (N) is made at Step 108, or in other words, when the transport direction length of the sheet S is larger than the specified size, the controller 100 executes image formation operation in a first monochrome productivity priority mode in which productivity is prioritized over image quality (Step 109). When affirmative determination (Y) is made at Step 108, on the other hand, the controller 100 executes image formation operation in a second monochrome productivity priority mode offering more improved productivity than the first monochrome productivity priority mode (Step 110). Note that a detailed description is to be given later as to the specified size of the sheet S, which is used in the determination at Step 108.

Next, using FIG. 1, FIGS. 4A and 4B, and FIGS. 5A to 5C, a description is given of the modes of image formation operation according to the present exemplary embodiment.

Figure 4A:
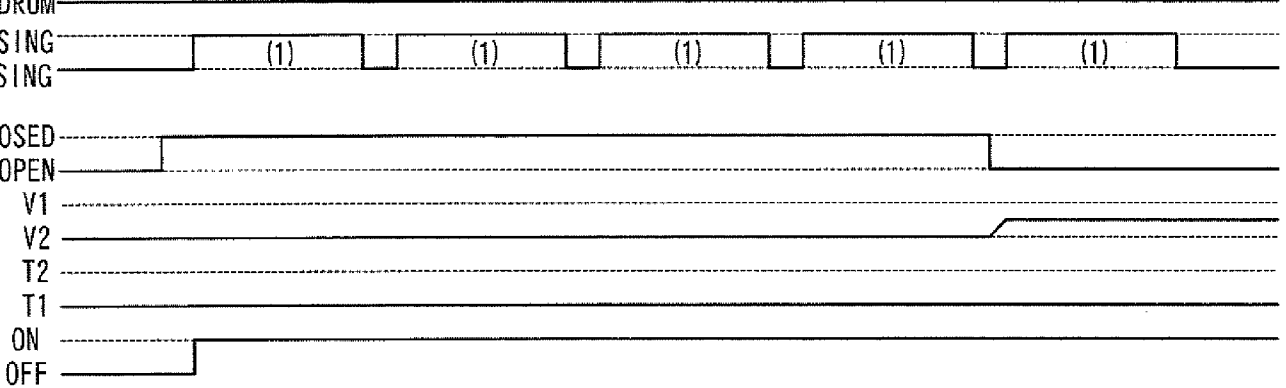
FIG. 4A shows an example of a timing chart for a multi-color image-quality priority mode.
Figure 4B:
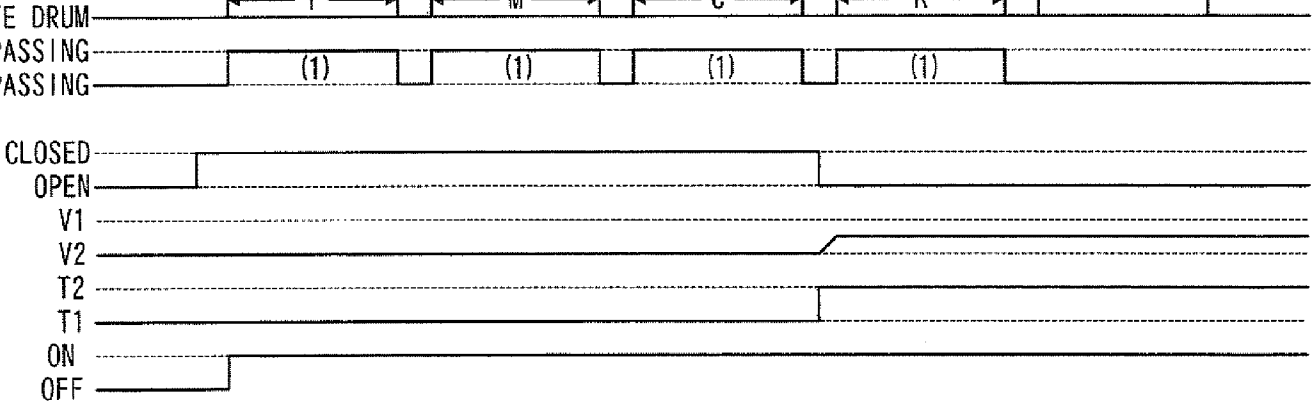
FIG. 4B shows an example of a timing chart for a multi-color productivity priority mode.

FIGS. 4A and 4B each show an example of a timing chart for the multi-color image formation. Specifically, FIG. 4A illustrates a timing chart for the multi-color image-quality priority mode, and FIG. 4B illustrates a timing chart for the multi-color productivity priority mode.

Figure 5A:
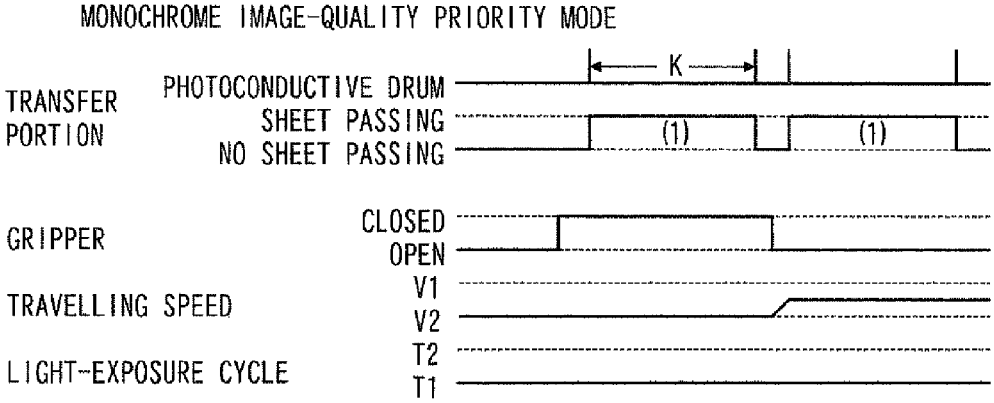
FIG. 5A shows an example of a timing chart for a monochrome image-quality priority mode.
Figure 5B:
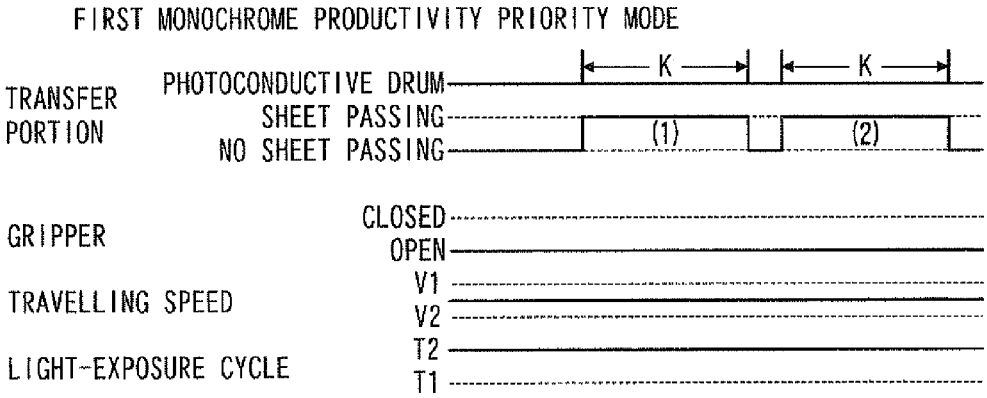
FIG. 5B shows an example of a timing chart for a first monochrome productivity priority mode.
Figure 5C:
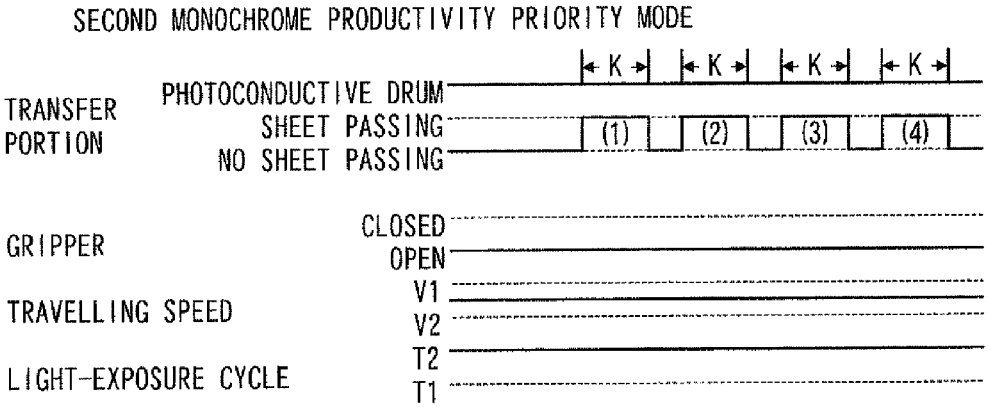
FIG. 5C shows an example of a timing chart for a second monochrome productivity priority mode.

FIGS. 5A to 5C each show an example of a timing chart for the monochrome image formation. Specifically, FIG. 5A illustrates a timing chart for the monochrome image-quality priority mode, FIG. 5B illustrates a timing chart for the first monochrome productivity priority mode, and FIG. 5C illustrates a timing chart for the second monochrome productivity priority mode.

FIGS. 4A and 4B and FIGS. 5A to 5C each show a relationship among time passage, the color of a toner image formed on the photoconductive drum 11 passing the transfer portion Tr, whether there is the sheet S passing the transfer portion Tr or not, whether the gripper 23 is open or closed, the travelling speed of the sheet S, and the cycle for light exposure by the light-exposing device 13.

In each of the modes, an image is formable on a single sheet S, and also on multiple sheets S sequentially. In FIGS. 4A and 4B and FIGS. 5A to 5C, an n-th sheet S to be fed and subjected to image formation is shown by (N).

In the following, the multi-color image formation is described first, and the monochrome image formation is described next.

Here, the multi-color image formation which is an example of first image formation operation is described taking an example of forming an image of yellow (Y), an image of magenta (M), an image of cyan C, and an image of black (K) in this order. The monochrome image formation which is an example of second image formation operation is described taking an example of forming an image of black (K).

In both of the multi-color image formation and the monochrome image formation, before the image formation operation is started, the gripper 23 is open with respect to the transfer drum 21, and a transfer bias is OFF.

In the following description, the gripper 23 is basically open and is closed when gripping the sheet S. Note, however, that the gripper 23 may be configured reversely, namely, may be configured to be basically closed and is open immediately before gripping the sheet S and when releasing the grip of the sheet S.

<Multi-Color Image-Quality Priority Mode>

First, with reference to FIGS. 1 and 4A, a description is given of the image formation operation in the multi-color image-quality priority mode shown in Step 104 of FIG. 3.

First, the controller 100 outputs a control signal to each of the constituents of the image forming apparatus 1 to instruct them to operate in the multi-color image-quality priority mode.

In addition, the controller 100 converts an image signal inputted from the image output instructor 90 into recording image data of each of the four colors, yellow (Y), magenta (M), cyan (C), and black (K), and outputs the recording image data to the light-exposing device 13 in order of yellow (Y), magenta (M), cyan (C), and black (K). Here, to the light-exposing device 13, the controller 100 outputs a control signal for setting the light-exposure cycle to a light-exposure cycle T1.

Upon receipt of the control signal from the controller 100, the photoconductive-drum drive section 81 rotates the photoconductive drum 11 at a rotation velocity V1, and the transfer-drum drive section 84 rotates the transfer drum 21 at a rotation velocity V2. As the photoconductive drum 11 and the transfer drum 21 start to rotate, the controller 100 receives a first phase signal from the rotation sensor 70, and a second phase signal from the phase sensor 25.

Here, the rotation velocity V1 of the photoconductive drum 11 and the rotation velocity V2 of the transfer drum 21 are not equal, and set so that one of them may be larger than the other. Setting one of the rotation velocities larger than the other is effective in that the relative velocity between the photoconductive drum 11 and the transfer drum 21 is maintained at a plus side or a minus side. In other words, by giving the photoconductive drum 11 and the transfer drum 21 a difference in their rotation velocities in advance, a magnitude relation of the rotation velocities is still maintainable even when the rotation velocities V1 and V2 of the respective drums change. Thus, transfer at the transfer portion Tr is made stable.

For example, in the present exemplary embodiment, the rotation velocities are set in advance so that the rotation velocity V2 of the transfer drum 21 may be 0.99 when the rotation velocity V1 of the photoconductive drum 11 is 1. Note that the difference between the rotation velocity V1 of the photoconductive drum 11 and the rotation velocity V2 of the transfer drum 21 is preferably on the order of 1%, considering the tolerance of the outer diameter of the transfer drum 21 and variation in how much the photoconductive drum 11 sinks into the transfer drum 21 at the transfer nip. Although V1 is larger than V2 here, V2 may be larger than V1, instead.

Then, after the photoconductive layer of the rotating photoconductive drum 11 is charged by the charging device 12, the light-exposing device 13 starts light exposure based on the phase of the photoconductive drum 11 obtained from the rotation sensor 70, and thereby forms an electrostatic latent image of a first color (e.g., yellow) according to the recording image data. Here, the light-exposing device 13 performs the light exposure at the light-exposure cycle T1.

Note that the gripper 23 is still open here.

Meanwhile, in the rotary developing device 14, the yellow developing part 14Y is at a stop at the development position, and is supplied with a development bias from the development-bias setting section 83. Then, the electrostatic latent image formed on the photoconductive drum 11 passes the development position and is thereby developed, so that a yellow toner image is formed on the photoconductive drum 11. Then, the yellow toner image thus developed is fed by the rotation of the photoconductive drum 11 to the transfer portion Tr facing the transfer drum 21.

Further, in response to the start of the image formation operation, the sheet feeding unit 40 feeds the sheet S. Specifically, the sheet S is picked up from the sheet housing part 41 by the pickup roll 42 in response to receipt of the control signal from the controller 100, and is transported through the separation rolls 43 to the second feeding route 512 by the transport rolls 44. Here, based on the phase of the transfer drum 21 obtained by the phase sensor 25, the controller 100 controls the transport of the sheet S so that the transport direction leading edge side of the sheet S may reach the second sheet feeding position Pa2 at the same time as when the gripper 23 reaches the second sheet feeding position Pa2. The travelling velocity of the sheet S at this time is equal to the rotation velocity V2 of the transfer drum 21.

Then, the controller 100 outputs a control signal to the gripper 23 at the same time as when the transport direction leading edge portion of the sheet S reaches the second sheet feeding position Pa2. Upon receipt of this control signal, the gripper 23 transitions from an open state to a closed state, and the transport direction leading edge portion of the sheet S is thereby gripped between the elastic layer 21B and the free edge of the gripper 23. As a result, the sheet S is transported while being placed around the transfer drum 21 and gripped by the gripper 23.

The travelling velocity of the sheet S at this time is equal to the rotation velocity V2 since the sheet S is gripped by the gripper 23 on the outer circumferential surface of the transfer drum 21. In other words, the sheet S at this time moves slower than the photoconductive drum 11.

Here, the controller 100 controls the timing at which the light-exposing device 13 exposes the rotating photoconductive drum 11 to light and the timing for driving the transfer drum 21 so that the transport direction leading edge side of the sheet S gripped by the gripper 23 on the transfer drum 21 may reach the transfer portion Tr at the same time as when a transport direction top edge portion of an area on the photoconductive drum 11 where the yellow toner image is formed reaches the transfer portion Tr. Note that this control is performed based on the phase of the photoconductive drum 11 obtained by the rotation sensor 70 and on the phase of the transfer drum 21 obtained by the phase sensor 25. Further, the controller 100 outputs a control signal to the transfer-bias setting section 85 at the same time as when the transport direction leading edge side of the sheet S reaches the transfer portion Tr, the control signal switching the transfer bias from OFF to ON.

Then, at the transfer portion Tr where the photoconductive drum 11 and the transfer drum 21 face each other, the toner image of the first color, yellow, formed on the photoconductive drum 11 is transferred onto the sheet S on the transfer drum 21 by the transfer bias supplied by the transfer-bias setting section 85. Note that the cleaning device 15 removes toner remaining on the photoconductive drum 11 after the transfer.

Thereafter, according to the procedure described above, a process of latent image formation, development, and transfer is repeated for the second and the rest of the colors, namely, magenta, cyan, and black, based on the corresponding recording image data. Note that the rotary developing device 14 rotates according to the control signal from the controller 100 to sequentially locate a corresponding one of the developing parts 14M, 14C, and 14K at the development position for the formation of the toner images of the respective colors. Note that, in this image formation operation, the color of the toner image to be developed on the photoconductive drum 11 is changed per revolution of the transfer drum 21 (per revolution of the sheet S placed around the transfer drum 21) by switching the developing part to be located at the development position, regardless of the size of the sheet S. Meanwhile, the sheet S is transported through the rotation route 53 while being gripped by the gripper 23 on the transfer drum 21 and thus rotating. Note that in this multi-color image-quality priority mode, the sheet S passes through the rotation route 53 four times in total.

A toner image of the next color is transferred every time the sheet S passes the transfer portion Tr, so that the toner images are transferred sequentially in a superimposed manner. As a result, the multiple toner images of yellow (Y), magenta (M), cyan (C), and black (K) are transferred onto the sheet S on the transfer drum 21. The sheet S therefore passes through the rotation route 53 four times and also passes the transfer portion Tr four times to have the toner images of yellow (Y), magenta (M), cyan (C), and black (K) transferred thereonto sequentially. In the formation of the toner images of yellow (Y), magenta (M), cyan (C), and black (K), the light-exposure cycle of the light-exposing device 13 is maintained at the light-exposure cycle T1.

In the multi-color image-quality priority mode, the sheet S is kept being gripped by the gripper 23 on the transfer drum 21 until the transfer of the toner image of the last color, namely black, is completed, or in other words, until a transport direction tail edge portion of the sheet S gripped on the transfer drum 21 passes the transfer portion Tr. Then, the controller 100 outputs a control signal to the gripper 23 after the black toner image is transferred and before the transport direction leading edge portion of the sheet S reaches the transfer portion Tr. With the control signal, the gripper 23 transitions from the closed state to the open state to release (loosen) the grip of the sheet S.

Note that the gripper 23 preferably transitions from the closed state to the open state at a position close to the transfer portion Tr. For example, the gripper 23 releases the grip of the sheet S at the second sheet feeding position Pa2, or more preferably, at the first sheet feeding position Pa1.

Then, the sheet S onto which the toner images of the four colors have been transferred passes the transfer portion Tr while being released from the grip by the gripper 23 on the transfer drum 21. Note that, in this multi-color image-quality priority mode, a single sheet S passes the transfer portion Tr five times in total. Of these five times, from the first time to the fourth time where the toner images are transferred, the sheet S passes the transfer portion Tr while being gripped on the transfer drum 21, and for the fifth time where no toner image needs to be transferred, the sheet S passes the transfer portion Tr while not being gripped on the transfer drum 21. Further, in this example, although the transfer bias is still supplied by the transfer-bias setting section 85 even when the sheet S passes the transfer portion Tr for the fifth time, no toner image is transferred onto the sheet S since there is no toner image formed on the photoconductive drum 11 here.

The travelling velocity of the sheet S changes between before and after the gripper 23 releases the grip of the sheet S and the sheet S passes the transfer portion Tr for the fifth time. The sheet S released from the grip is affected by both the rotation velocity V2 of the transfer drum 21 and the rotation velocity V1 of the photoconductive drum 11, and therefore has a velocity between the rotation velocity V2 of the transfer drum 21 and the rotation velocity V1 of the photoconductive drum 11. In the example described above, the rotation velocity V2 of the transfer drum 21 is 0.99 when the rotation velocity V1 of the photoconductive drum 11 is 1. Accordingly, the travelling velocity of the sheet S here is, for example, 0.995.

When the sheet S having the multiple toner images superimposed thereon and having been released from the grip by the gripper 23 on the transfer drum 21 is pressed by the photoconductive drum 11 against the elastic layer 218 of the transfer drum 21 at the transfer portion Tr, the sheet S is separated from the transfer drum 21, at its transport direction leading edge portion. Then, the sheet S enters the output route 52 from the sheet output position Pb where the sheet S is separated from the transfer drum 21. The sheet S is then fed to a fixing nip portion where the heating roll 31 and the pressing roll 32, of the fixing device 30, are in press contact with each other. In this fixing nip portion, the toner images on the sheet S are fixed. The sheet S after the fixation is outputted to the outside of the image forming apparatus 1 by the transport rolls 44 and is stacked in the outputted-sheet stacking unit 3.

<Multi-Color Productivity Priority Mode>

Next, referring to FIGS. 1 and 4B, a description is given of the image formation operation in the multi-color productivity priority mode shown in Step 105 of FIG. 3.

The image formation operation in the multi-color productivity priority mode is performed basically in the same way as that in the multi-color image-quality priority mode described above, but is different from the multi-color image-quality priority mode in, for example, how a black toner image is transferred, the black toner being the last toner image to be transferred onto the sheet S on the transfer drum 21 among the multiple yellow (Y), magenta (M), cyan (C), and black (K) toner images to be transferred.

Specifically, in the multi-color image-quality priority mode, the gripper 23 releases the grip of the sheet S after the transfer of the toner image of the last color, namely black. In contrast, in the multi-color productivity priority mode, the gripper 23 releases the grip before the transfer of the black toner image starts. In other words, the sheet S is gripped by the gripper 23 while the yellow (Y), magenta (M), and cyan (C) toner images are sequentially transferred. However, the gripper 23 transitions from the closed state to the open state to release the grip of the sheet S after completion of the transfer of the toner image of cyan (C) which is a second last color and before the transport direction leading edge portion of the sheet S reaches the transfer portion Tr so as to have a black toner image transferred thereonto. Then, the sheet S is not gripped by the gripper 23 during the transfer of the black toner image.

Note that the position where the gripper 23 transitions from the closed state to the open state is preferably close to the transfer portion Tr, as described earlier. For example, the gripper 23 releases the grip of the sheet S at the second sheet feeding position Pa2, or more preferably, at the first sheet feeding position Pa1.

Then, after the toner image of the last color, black, is transferred, the sheet S enters the output route 52 from the sheet output position Pb without passing through the rotation route 53, and is fed to the fixing device 30. In other words, in the multi-color productivity priority mode, the sheet S is separated at the sheet output position Pb from the transfer drum 21 while having the toner image of the last color, black, transferred thereonto.

Accordingly, in the multi-color productivity priority mode, a single sheet S passes the transfer portion Tr four times in total. Among those four times, the sheet S is gripped by the gripper 23 on the transfer drum 21 until passing the transfer portion Tr for the third time, and is not gripped by the gripper 23 on the transfer drum 21 when passing the transfer portion Tr for the last fourth time. Note that the transfer bias is still supplied by the transfer-bias setting section 85 when the sheet S passes the transfer portion Tr for the fourth time. Note that, in the multi-color productivity priority mode, the sheet S passes through the rotation route 53 three times in total.

In the multi-color image-quality priority mode, as described earlier, a single sheet S passes the transfer portion Tr five times in total and passes through the rotation route 53 four times in total. In the multi-color productivity priority mode, a single sheet S passes the transfer portion Tr four times in total and passes through the rotation route 53 three times in total. Accordingly, the multi-color productivity priority mode has higher productivity than the multi-color image-quality priority mode. Note that, in the present invention, a certain mode has higher productivity than a different mode involving the same number of colors for the image formation as the certain mode when the certain mode takes a shorter time to form an image on a single sheet S than the different mode.

The multi-color productivity priority mode is different from the multi-color image-quality priority mode in the following point as well, in association with the fact that, in the multi-color productivity priority mode, the sheet S is not gripped by the gripper 23 in the transfer of the black toner image. Specifically, the multi-color productivity priority mode adjusts the light-exposure cycle T1 of the light-exposing device 13 in response to a change in the travelling velocity of the sheet S, and is thus different from the multi-color image-quality priority mode.

First, in the multi-color productivity priority mode, since the sheet S is gripped by the gripper 23 while the yellow (Y), magenta (M), and cyan (C) toner images are transferred, the travelling velocity of the sheet S is equal to the rotation velocity V2 of the transfer drum 21. In the above example, the rotation velocity V2 of the transfer drum 21 is 0.99.

Unlike the multi-color image-quality priority mode, in the multi-color productivity priority mode, the sheet S is not gripped by the gripper 23 when the black toner image is transferred. Accordingly, as described above, the sheet S is affected by both of the velocity of the transfer drum 21 and the velocity of the photoconductive drum 11, to have a travelling velocity between the rotation velocity V2 of the transfer drum 21 and the rotation velocity V1 of the photoconductive drum 11 (see FIG. 4B). In the example described above, the rotation velocity V2 of the transfer drum 21 is 0.99 when the rotation velocity V1 of the photoconductive drum 11 is 1; therefore, the travelling velocity of the sheet S here is the intermediate velocity therebetween, that is, 0.995 for example.

In the multi-color productivity priority mode, in response to the travelling velocity of the sheet S changing as described above, the light-exposure cycle of the light-exposing device 13 for forming the toner image of the last color, black, on the photoconductive drum 11 is changed. Specifically, in the present exemplary embodiment, the light-exposure cycle of the light-exposing device 13 is changed after the formation of the toner image of the second last color, cyan (C), and before the formation of the toner image of the last color, black. More specifically, in the multi-color productivity priority mode, the light-exposure cycle of the light-exposing device 13 is the light-exposure cycle T1 while the yellow (Y), magenta (M), and cyan (C) toner images are formed. In contrast, in the multi-color productivity priority mode, when the black toner image is formed, the controller 100 outputs a control signal to the light-exposing device 13 to change the light-exposure cycle to a light-exposure cycle T2 which is different from the light-exposure cycle T1. By changing the light-exposure cycle of the light-exposing device 13 in associated with whether the sheet S is gripped or not, the black toner image is less likely to be transferred onto the sheet S with a magnification thereof in the second scan direction being different from those of the toner images of the other three colors (yellow (Y), magenta (M), and cyan (C)).

In the above example, while the yellow (Y), magenta (M), and cyan (C) toner images are transferred, the sheet S is gripped by the gripper 23, and therefore travels with a velocity equal to the rotation velocity V2 of the transfer drum 21, specifically, 0.99. While the black toner image is transferred, the sheet S is not gripped by the gripper 23, and therefore travels with a velocity of 0.995. In response to this change in velocity, the light-exposure cycle of the light-exposing device 13 is changed. Specifically, a ratio of the light-exposure cycle T1 of the light-exposing device 13 used during the formation of the yellow (Y), magenta (M), and cyan (C) toner images to the light-exposure cycle T2 of the light-exposing device 13 used during the formation of the black toner image is the reciprocal of a ratio of the travelling velocity of the sheet S during the transfer of the yellow (Y), magenta (M), and cyan (C) toner images to the travelling velocity of the sheet S during the transfer of the black toner image.

<Monochrome Image-Quality Priority Mode>

Next, referring to FIGS. 1 and 5A, a description is given of the image formation operation in the monochrome image-quality priority mode shown in Step 107 of FIG. 3.

The monochrome image-quality priority mode is the same as the above-described multi-color image-quality priority mode, except that an electrostatic latent image on the photoconductive drum 11 is developed only by the black developing part 14K, and that the transfer at the transfer portion Tr is performed only once, which is for the black toner image. Specifically, the toner image transfer is started after the sheet S fed through the second feeding route 512 to the second sheet feeding position Pa2 is gripped by the gripper 23 on the transfer drum 21.

In the monochrome image-quality priority mode, a single sheet S passes the transfer portion Tr twice in total. Among those two times, the sheet S is gripped by the gripper 23 on the transfer drum 21 when passing the transfer portion Tr for the first time, whereas the sheet S is not gripped by the gripper 23 on the transfer drum 21 when passing the transfer portion Tr for the second time. Further, the sheet S passes through the rotation route 53 once while being gripped by the gripper 23 on the transfer drum 21. Then, although not shown in FIG. 5, a transfer bias supplied by the transfer-bias setting section 85 is kept being applied when the sheet S having the black toner image transferred thereonto passes the transfer portion Tr for the second time. However, a toner image is not transferred onto the sheet S here since no toner image is formed on the photoconductive drum 11.

Like the situation where the sheet S passes the transfer portion Tr for the last time in the multi-color image-quality priority mode, in the monochrome image-quality priority mode, the travelling velocity of the sheet S changes between before and after the sheet S is released from the grip by the gripper 23 and passes the transfer portion Tr for the second time. The travelling velocity of the sheet S becomes a velocity between the rotation velocity V2 of the transfer drum 21 and the rotation velocity V1 of the photoconductive drum 11. In the above example, the rotation velocity V2 of the transfer drum 21 is 0.99 when the rotation velocity V1 of the photoconductive drum 11 is 1. Accordingly, the travelling velocity of the sheet S is, for example, 0.995.

Note that, in the monochrome image-quality priority mode, the light exposure is performed with the light-exposure cycle T1 from beginning to end.

<First Monochrome Productivity Priority Mode>

Next, referring to FIGS. 1 and 5B, a description is given of the image formation operation in the first monochrome productivity priority mode shown in Step 109 of FIG. 3.

Selection between the first monochrome productivity priority mode and the second monochrome productivity priority mode is made based on a result of a comparison between the transport direction length of the sheet S on which an image is to be formed and the predetermined, specified size (see FIG. 3).

The specified size in the present exemplary embodiment is half the circumferential length of the elastic layer 21B of the transfer drum 21.

In the first monochrome productivity priority mode selected when the transport direction length of the sheet S is larger than the specified size, one sheet S is fed per revolution of the transfer drum 21. In the second monochrome productivity priority mode selected when the transport direction length of the sheet S is equal to or smaller than the specified size, two or more sheets S are fed per revolution of the transfer drum 21.

The monochrome image-quality priority mode described above is effective when, for example, the positioning of an image on the sheet S needs to be accurate (such as printing for postcards or form-filling).

The image formation operation in the first monochrome productivity priority mode is performed basically in the same way as that in the monochrome image-quality priority mode described above, but is different as follows. Specifically, when a black toner image is transferred, the sheet S is gripped by the gripper 23 in the monochrome image-quality priority mode, but is not gripped by the gripper 23 in the first monochrome productivity priority mode.

The first monochrome productivity priority mode is different from the monochrome image-quality priority mode in the following point, in association with the fact that the sheet S is not gripped by the gripper 23 in the first monochrome productivity priority mode.

First, in response to a start of the image formation operation, the sheet feeding unit 40 starts feeding the sheet S. Specifically, the sheet feeding unit 40 receives an output from the controller 100, and transports the sheet S picked up from the sheet housing part 41 by the pickup roll 42, to the first feeding route 511. Here, based on the phase of the transfer drum 21 obtained by the phase sensor 25, the controller 100 controls the travelling of the sheet S so that the transport direction leading edge side of the sheet S may be brought to the first sheet feeding position Pa1. The travelling velocity of the sheet S here is set to a velocity between the rotation velocity V2 of the transfer drum 21 and the rotation velocity V1 of the photoconductive drum 11. Since the sheet S is not gripped by the gripper 23, the sheet S does not need to be fed to the gripper 23 when fed to the first sheet feeding position Pa1, unlike the three modes of the image formation operation described above.

Next, the sheet S having a black toner image transferred thereunto does not pass through the rotation route 53, but is transported to the fixing device 30 by entering the output route 52 from the sheet output position Pb where the sheet S is separated from the transfer drum 21. In other words, the sheet S is separated from the transfer drum 21 at the sheet output position Pb while having the black toner image transferred thereonto.

Accordingly, in the first monochrome productivity priority mode, the sheet S passes the transfer portion Tr only once without being gripped by the gripper 23 on the transfer drum 21, and does not rotate with the transfer drum 21. As described earlier, in the monochrome image-quality priority mode, a single sheet S passes the transfer portion Tr twice in total and passes through the rotation route 53 once; therefore, the first monochrome productivity priority mode offers higher productivity than the monochrome image-quality priority mode.

The first monochrome productivity priority mode is different from the monochrome image-quality priority mode in the travelling velocity of the sheet S and the light-exposure cycle of the light-exposing device 13, in association with the fact that the sheet S is not gripped by the gripper 23 when a black toner image is transferred in the first monochrome productivity priority mode.

First, the travelling velocity of the sheet S is considered. In the monochrome image-quality priority mode, the sheet S is gripped by the gripper 23 while having a black toner image transferred thereonto, and therefore has a travelling velocity equal to the rotation velocity V2 of the transfer drum 21. In contrast, in the first monochrome productivity priority mode, the sheet S is not gripped by the gripper 23, and therefore has a travelling velocity between the rotation velocity V2 of the transfer drum 21 and the rotation velocity V1 of the photoconductive drum 11 (see FIG. 5B). In the example described above, the rotation velocity V2 of the transfer drum 21 is 0.99 when the rotation velocity V1 of the photoconductive drum 11 is 1; therefore, the travelling velocity of the sheet S here is the intermediate velocity therebetween, that is, 0.995 for example.

In the first monochrome productivity priority mode, since the velocity at which the sheet S travels when the transfer is performed at the transfer portion Tr is different from that in the monochrome image-quality priority mode, the light-exposure cycle of the light-exposing device 13 is maintained at the light-exposure cycle T2 which is different from the light-exposure cycle T1 employed in the monochrome image-quality priority mode (see FIG. 5B). Thereby, the black toner image transferred onto the sheet S is less likely to have an unintended magnification in the second scan direction. Specifically, a ratio of the light-exposure cycle T1 of the light-exposing device 13 in the monochrome image-quality priority mode to the light-exposure cycle T2 of the light-exposing device 13 in the first monochrome productivity priority mode is the reciprocal of a ratio of the rotation velocity V2 which is the travelling velocity of the sheet S gripped by the gripper 23 in the monochrome image-quality priority mode to the rotation velocity V1 which is the travelling velocity of the sheet S having a toner image transferred thereonto in the first monochrome productivity priority mode. In the above example, since the light-exposure cycle T1 is 0.995, the light-exposure cycle T2 of the light-exposing device 13 when the black toner image is formed is 0.99.

As described earlier, in the first monochrome productivity priority mode, the sheet S does not need to be fed to the gripper 23 at the first sheet feeding position Pa1 to which the sheet S is fed. Therefore, the sheet S is feedable without regard to the phase of the transfer drum 21, as long as the sheet S does not cross over the exposed portion 21C.

As described above, the first monochrome productivity priority mode is employed when an image is to be formed on the sheet S larger than the specified size, which is half the circumferential length of the elastic layer 21B of the transfer drum 21. To feed the sheet S so that the sheet S may not overlap with another sheet S and may not cross over the exposed portion 21C of the transfer drum 21, one sheet S needs to be fed at least per revolution of the transfer drum 21.

<Second Monochrome Productivity Priority Mode>

Next, referring to FIGS. 1 and 5C, a description is given of the image formation operation in the second monochrome productivity priority mode shown in Step 110 of FIG. 3.

The image formation operation in the second monochrome productivity priority mode is performed basically in the same way as that in the above-described first monochrome productivity priority mode, but the timing for feeding the sheet S is different.

Specifically, one sheet S is fed per revolution of the transfer drum 21 in the first monochrome productivity priority mode, whereas two or more sheets S are fed per revolution of the transfer drum 21 in the second monochrome productivity priority mode. This is described in more detail below.

First, like the above-described first monochrome productivity priority mode, in the second monochrome productivity priority mode, the sheet S is fed through the first feeding route 511 to the first sheet feeding position Pa1. Here, the sheet S is not gripped by the gripper 23 on the transfer drum 21, and therefore does not need to be fed to the gripper 23. Accordingly, as long as the sheet S does not cross over the exposed portion 21C, the sheet S is feedable without any restriction by the phase of the transfer drum 21. Moreover, in the second monochrome productivity priority mode, since the transport direction length of the sheet S is equal to or smaller than the specified size which is half of the circumferential length of the elastic layer 21B of the transfer drum 21, two or more sheets S are allowed to be fed per revolution of the transfer drum 21 (see (1) and (2) in FIG. 5C). Accordingly, the second monochrome productivity priority mode has higher productivity than the first monochrome productivity priority mode in which one sheet S is fed per revolution of the transfer drum 21.

Now, using FIGS. 6A to 6D, a summary of the above-described modes of the image formation operation is given. FIGS. 6A to 6D are conceptual diagrams illustrating the travelling paths of the sheet S which are different from one mode to another.

As FIGS. 6A to 6D show, the five modes of the image formation operation in the present exemplary embodiment are different from one another particularly in the path that the sheet S passes through (see the solid lines in FIGS. 6A to 6D). Specifically, the five modes are different from one another in through which of the first feeding route 511 and the second feeding route 512 the sheet S is fed, and in the number of times by which the sheet S passes through the rotation route 53. Note that the output route 52 is the same for all of the five modes of the image formation operation in the present exemplary embodiment. In other words, the sheet S is outputted from the transfer drum 21 by passing through the output route 52 in all of the image formation modes.

Figure 6A:
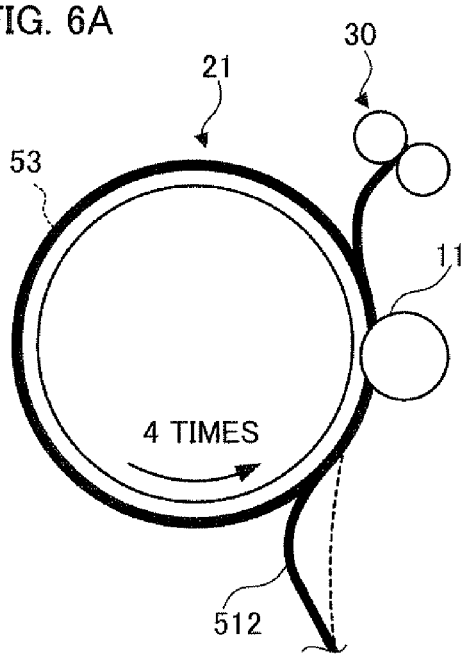
FIGS. 6A to 6D are conceptual diagrams illustrating how a sheet passes in the respective modes of the image formation operation.

In the multi-color image-quality priority mode, as FIG. 6A shows, the sheet S is fed through the second feeding route 512, passes through the rotation route 53 around the transfer drum 21 four times (i.e., rotates four times with the transfer drum 21), and is then fed to the fixing device 30 through the output route 52.

Figure 6B:
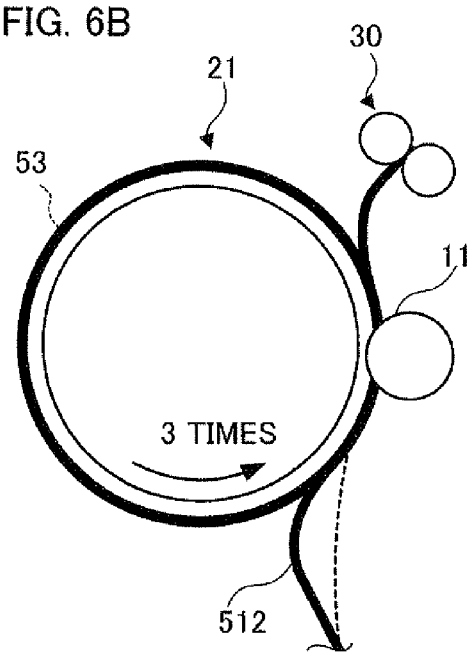

In the multi-color productivity priority mode, as FIG. 6B shows, the sheet S is fed through the second feeding route 512, passes through the rotation route 53 around the transfer drum 21 three times (i.e., rotates three times with the transfer drum 21), and is then fed to the fixing device 30 through the output route 52.

Accordingly, in a comparison between the multi-color image-quality priority mode and the multi-color productivity priority mode, the number of times the sheet S passes through the rotation route 53 around the transfer drum 21 (the number of times the sheet S rotates with the transfer drum 21) in the multi-color productivity priority mode is smaller than that in the multi-color image-quality priority mode.

The multi-color image-quality priority mode performs transfer for all colors with the sheet S being gripped by the gripper 23 on the transfer drum 21, and therefore allows the position of an image on the sheet S to be controlled more accurately than the multi-color productivity priority mode. Further, in the multi-color image-quality priority mode, transfer for all colors is performed in a constant state, that is, with the sheet S being gripped by the gripper 23 on the transfer drum 21. Accordingly, images of the respective colors are less likely to be superimposed on the sheet S at positions shifted from one another.

Figure 6C:
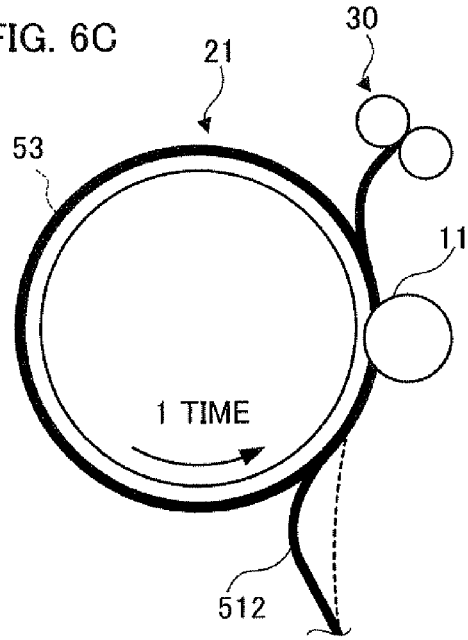

Next, in the monochrome image-quality priority mode, as FIG. 6C shows, the sheet S is fed through the second feeding route 512, passes through the rotation route 53 around the transfer drum 21 once (i.e., rotates once with the transfer drum 21), and is then fed to the fixing device 30 through the output route 52.

Figure 6D:
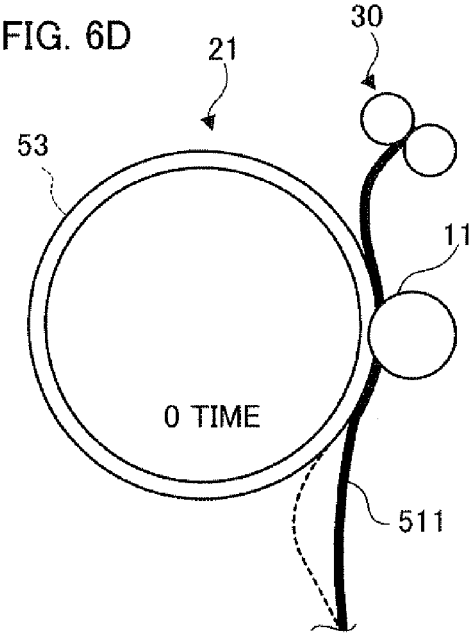

In the first monochrome productivity priority mode and the second monochrome productivity priority mode, as FIG. 6D shows, the sheet S is fed through the first feeding route 511, and is fed to the fixing device 30 through the output route 52 without passing through the rotation route 53 around the transfer drum 21.

Accordingly, in a comparison between the monochrome image-quality priority mode and the first monochrome productivity priority mode (and the second monochrome productivity priority mode), the number of times the sheet S passes through the rotation route 53 around the transfer drum 21 (the number of times the sheet S rotates with the transfer drum 21) in the first monochrome productivity priority mode (and the second monochrome productivity priority mode) is smaller than that in the monochrome image-quality priority mode.

The monochrome image-quality priority mode performs transfer with the sheet S being gripped by the gripper 23 on the transfer drum 21, and therefore allows the position of an image on the sheet S to be controlled more accurately than the first monochrome productivity priority mode (and the second monochrome productivity priority mode).

In the multi-color image-quality priority mode, the multi-color productivity priority mode, and the monochrome image-quality priority mode (in which the sheet S is gripped on the transfer drum 21), the sheet S is fed through the second feeding route 512 to the second sheet feeding position Pa2 in order to prevent the sheet S from reaching the transfer portion Tr before being completely gripped by the gripper 23.

On the other hand, in the first monochrome productivity priority mode and the second monochrome productivity priority mode (in which the sheet S is not gripped on the transfer drum 21), the sheet S is fed through the first feeding route 511 to the first sheet feeding position Pa1 in order to prevent the sheet S from being separated from the transfer drum 21 before reaching the transfer portion Tr or from being stuck at the nip portion between the transfer drum 21 and the photoconductive drum 11 at the transfer portion Tr.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that is rotatably installed and carries an image on an outer circumferential surface of the image carrier;

a transfer member that is rotatably installed facing the image carrier, and transfers the image carried on the outer circumferential surface of the image carrier onto a recording medium nipped between the transfer member and the image carrier;

a holding member that holds, on an outer circumferential surface of the transfer member, the recording medium fed to the transfer member; and a control unit that performs control so that in first image formation operation in which images of a plurality of colors carried by the image carrier are sequentially transferred onto a single recording medium one color at a time, the holding member holds the recording medium on the transfer member, and in second image formation operation in which an image of a single color carried by the image carrier is transferred onto a single recording medium, the holding member does not hold the recording medium on the transfer member.

2. The image forming apparatus according to claim 1, wherein, in the first image formation operation, the control unit performs control so that the holding member holds the recording medium on the transfer member while the image of each color of the plurality of colors other than a last color is being transferred onto the recording medium, the image of the each color carried before the image of the last color finally carried by the image carrier, and the holding member releases the holding of the recording medium on the transfer member while the image of the last color is being transferred onto the recording medium.

3. The image forming apparatus according to claim 1, wherein, in the second image formation operation, the control unit performs control so that the holding member holds the recording medium on the transfer member when a length of the recording medium in a transport direction of the recording medium is larger than a length predetermined based on a length of the outer circumferential surface of the transfer member in a rotation direction of the transfer member.

4. An image forming apparatus comprising:

an image carrier that is rotatably installed and carries an image on an outer circumferential surface of the image carrier;

a transfer member that is rotatably installed facing the image carrier, and transfers the image carried on the outer circumferential surface of the image carrier onto a recording medium nipped between the transfer member and the image carrier;

a holding member that holds, on an outer circumferential surface of the transfer member, the recording medium fed to the transfer member; and a control unit that performs control so that in first image formation operation in which image quality of an image transferred on the recording medium is prioritized over productivity of producing the recording medium having the image transferred thereonto, the holding member holds the recording medium on the transfer member, and in second image formation operation in which the productivity is prioritized over the image quality, the holding member does not hold the recording medium on the transfer member.

5. The image forming apparatus according to claim 4, wherein, in the second image formation operation, the control unit causes a single recording medium to be fed to the transfer member per revolution of the transfer member when a length of the recording medium in a transport direction of the recording medium is larger than a reference length predetermined based on a length of the outer circumferential surface of the transfer member in a rotation direction of the transfer member, and causes two or more recording medium to be sequentially fed to the transfer member per revolution of the transfer member when the length in the transport direction is equal to or smaller than the reference length.

6. An image forming apparatus comprising:

an image forming unit that forms an image;

an image carrier that is rotatably installed and carries the image, formed by the image forming unit, on an outer circumferential surface of the image carrier;

a transfer member that is rotatably installed facing the image carrier, and transfers the image carried on the outer circumferential surface of the image carrier onto a recording medium nipped between the transfer member and the image carrier;

a holding member that holds, on an outer circumferential surface of the transfer member, the recording medium fed to the transfer member; and a setting part that sets whether or not to cause the holding member to hold the recording medium on the transfer member, based on a command made for an output of the image formed by the image forming unit.

* * * * *